US006295838B1

(12) United States Patent
Shah et al.

(10) Patent No.: US 6,295,838 B1
(45) Date of Patent: Oct. 2, 2001

(54) CRYOGENIC AIR SEPARATION AND GAS TURBINE INTEGRATION USING HEATED NITROGEN

(75) Inventors: Minish Mahendra Shah, East Amherst; Raymond Francis Drnevich, Clarence Center; Nancy Jean Lynch, No. Tonawanda; Kevin William Mahoney, Amherst, all of NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/638,883

(22) Filed: Aug. 16, 2000

(51) Int. Cl.[7] ..... F25J 3/02
(52) U.S. Cl. ..... 62/643; 62/651
(58) Field of Search ..... 62/643, 646, 648, 62/650, 651

(56) References Cited

U.S. PATENT DOCUMENTS

| | | | | |
|---|---|---|---|---|
| 4,224,045 | * | 9/1980 | Olszewski et al. | 62/643 |
| 4,733,528 | * | 3/1988 | Pinto | 60/39.12 |
| 5,251,451 | * | 10/1993 | Xu et al. | 62/646 |
| 5,295,351 | * | 3/1994 | Rathbone | 60/39.05 |
| 5,317,862 | * | 6/1994 | Rathbone | 60/39.05 |
| 5,406,786 | * | 4/1995 | Scharpf et al. | 60/39.05 |
| 5,666,823 | * | 9/1997 | Smith et al. | 62/646 |
| 5,722,259 | * | 3/1998 | Sorensen et al. | 62/646 |
| 6,141,950 | * | 11/2000 | Smith et al. | 60/39.02 |

* cited by examiner

*Primary Examiner*—William Doerrler
(74) *Attorney, Agent, or Firm*—Stanley Ktorides

(57) ABSTRACT

An integrated cryogenic air separation gas turbine system wherein heat of compression within the feed air is provided to nitrogen produced in the cryogenic air separation plant and the heated nitrogen is provided to a gas turbine along with combustion reaction products to produce power.

12 Claims, 2 Drawing Sheets

CRYOGENIC AIR SEPARATION AND GAS TURBINE INTEGRATION USING HEATED NITROGEN

TECHNICAL FIELD

This invention relates generally to cryogenic air separation and, more particularly, to the integration of cryogenic air separation with a gas turbine system.

BACKGROUND ART

Gas turbines are employed to generate power. In a gas turbine system fuel and oxidant are combusted to form pressurized combustion products which are then expanded in the gas turbine to generate power.

Cryogenic air separation plants may be integrated with gas turbine systems. For example, a common compressor may compress air for combustion in the gas turbine system and also for separation in the cryogenic air separation plant. In addition, one or more products from the cryogenic air separation plant may be used in the gas turbine system. Any improvement in the integration of cryogenic air separation and gas turbine systems would be advantageous.

Accordingly, it is an object of this invention to provide an improved cryogenic air separation and gas turbine integration system.

SUMMARY OF THE INVENTION

The above and other objects, which will become apparent to those skilled in the art upon a reading of this disclosure, are attained by the present invention, one aspect of which is:

A method for operating a cryogenic air separation and gas turbine system comprising:

(A) compressing feed air to produce compressed feed air having heat of compression, and cooling the compressed feed air;

(B) passing the compressed feed air into a cryogenic air separation plant and producing nitrogen by the cryogenic rectification of the feed air within the cryogenic air separation plant;

(C) withdrawing nitrogen from the cryogenic air separation plant and heating the withdrawn nitrogen by indirect heat exchange with the compressed feed air having heat of compression to produce heated nitrogen; and (D) turboexpanding the heated nitrogen in a gas turbine.

Another aspect of the invention is:

Cryogenic air separation and gas turbine apparatus comprising:

(A) a feed air compressor, a high level heat exchanger, means for passing feed air to the feed air compressor, and means for passing feed air from the feed air compressor to the high level heat exchanger;

(B) a cryogenic air separation plant and means for passing feed air from the high level heat exchanger to the cryogenic air separation plant;

(C) means for passing nitrogen from the cryogenic air separation plant to the high level heat exchanger; and (D) a gas turbine and means for passing nitrogen from the high level heat exchanger to the gas turbine.

As used herein the term "cryogenic air separation plant" means a facility for fractionally distilling feed air by cryogenic rectification, comprising one or more columns and the piping, valving, etc. attendant thereto.

As used herein the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays plates mounted within the column and/or on packing elements such as structured or random packing. For a further discussion of distillation columns, see Chemical Engineer's Handbook, fifth edition, edited by R. H. Perry and C. H. Chilton, McGraw-Hill Book Company, New York, Section 13, *The Continuous Distillation Process.*

The term "double column" is used to mean a higher pressure column having its upper portion in heat exchange relation with the lower portion of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Distillation is the separation process whereby heating of a liquid mixture can be used to concentrate the more volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component (s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases can be adiabatic or nonadiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein the term "indirect heat exchange" means the bringing of two fluids into heat exchange relation without any physical contact or intermixing of the fluids with each other.

As used herein the term "feed air" means a mixture comprising primarily oxygen and nitrogen, such as ambient air.

As used herein the term "heat of compression" means thermal energy imparted to a fluid as a result of the compression of that fluid.

As used herein the term "turbine" means a device which converts pressure energy of a fluid into shaft energy by expansion of the fluid. The shaft energy can be utilized in driving a compressor and/or a generator for power generation.

As used herein the term "gas turbine" means a turbine wherein combustion products are expanded.

As used herein the term "nitrogen turbine" means a turbine wherein nitrogen but no combustion products is expanded.

As used herein the term "combustor" means an enclosure wherein fuel and oxidant are combusted to form combustion products.

As used herein the term "humidifier" means a device wherein moisture is added to gas.

DETAILED DESCRIPTION

Figure 1:
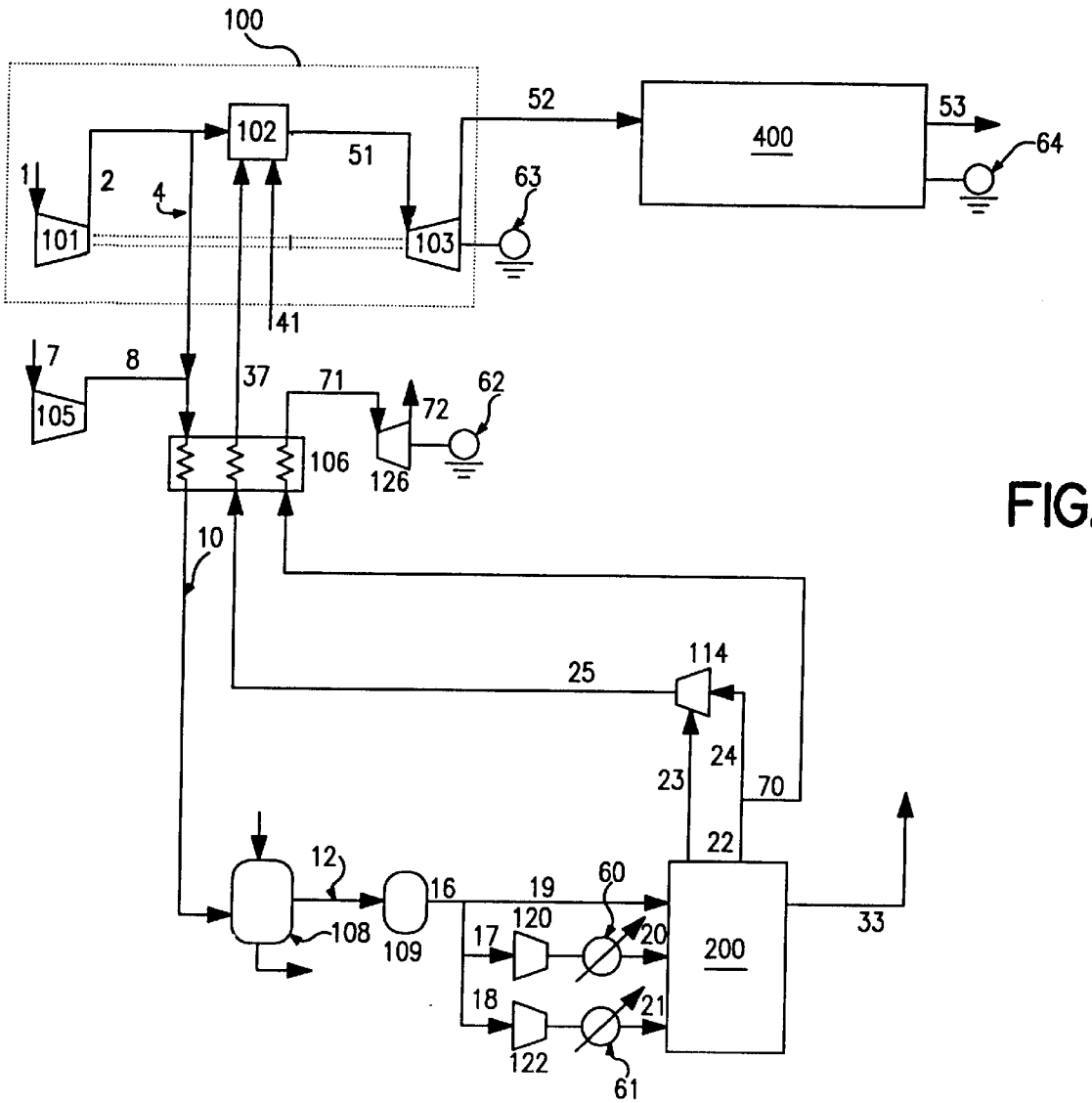
FIG. 1 is a schematic representation of one preferred embodiment of the cryogenic air separation gas turbine integration system of this invention.

The invention will be described in detail with reference to the Drawings. Referring now to FIG. 1, feed air 7 is compressed in feed air compressor 105 to a pressure generally within the range of from 60 to 450 pounds per square inch absolute (psia). Compressor 105 does not contain intercoolers so that resulting compressed feed air 8 contains the heat of compression resulting from the compression through non-intercooled compressor 105. Compressed feed air 8 is passed to high level heat exchanger 106 wherein it is cooled by indirect heat exchange with nitrogen produced in the cryogenic air separation plant as will be further described below. Resulting cooled compressed feed air 10 is further cooled in direct contact aftercooler against cooling water and resulting feed air stream 12 is passed to prepurifier 109 wherein it is cleaned of high boiling impurities such as carbon dioxide, water vapor and hydrocarbons to produce cleaned, cooled, compressed feed air stream 16.

In the embodiment of the invention illustrated in FIG. 1, feed air stream 16 is divided into three portions. One portion, referred to as main air, generally comprising from 60 to 75 percent of stream 16, is sent directly to cryogenic air separation plant 200 as stream 19. Another portion 17, referred to a liquid oxygen pumping air, generally comprising from 25 to 30 percent of stream 16, is compressed further in booster compressor 120, cooled in aftercooler 60 and sent to plant 200 as stream 20. Stream 20 is used in liquid oxygen pumping cycles where oxygen liquid is boiled against a condensing high pressure air stream. Another portion 18, referred to as refrigeration air, is compressed using a compressor 122 that is linked to an expander of plant 200, cooled in aftercooler 61 and then fed into plant 200 as stream 21 wherein it is expanded to generate refrigeration.

Cryogenic air separation plant 200 may be any cryogenic air separation plant which produces a nitrogen product. Examples of such cryogenic air separation plants include a single column plant for producing nitrogen, a double column plant which produces both nitrogen and oxygen, and a double column plant with an argon sidearm column which produces nitrogen, oxygen and argon. Within cryogenic air separation plant 200 the feed air is separated by cryogenic rectification resulting in the production of nitrogen. In the embodiment illustrated in FIG. 1, oxygen is also produced by the operation of cryogenic air separation plant 200 and is withdrawn and recovered in stream 33.

Nitrogen, produced in cryogenic air separation plant 200, is withdrawn from plant 200 in stream 22 which has a nitrogen concentration generally of at least 60 mole percent. If plant 200 produces more nitrogen than can be usefully employed in the gas turbine, such excess nitrogen may be used to generate additional power. In the embodiment illustrated in FIG. 1, this excess nitrogen is shown as stream 70 which is heated by passage through high level heat exchanger 106 by indirect heat exchange with cooling compressed feed air, and resulting heated excess nitrogen 71 is expanded through nitrogen turbine 126 to recover power such as to drive generator 62 to produce electricity. Resulting expanded excess nitrogen 72 may then be recovered in whole or in part or may be vented.

Some or all of the nitrogen produced in cryogenic air separation plant 200 is passed in stream 24 to compressor 114 wherein it is compressed to a pressure generally within the range of from 150 to 600 psia. In the event plant 200 also produces high pressure nitrogen, such high pressure nitrogen may be passed to a downstream stage of compressor 114 as shown by line 23.

Compressed nitrogen stream 25 is passed to high level heat exchanger 106 wherein it is heated by indirect heat exchange with the cooling compressed feed air 8 having heat of compression to produce heated nitrogen 37 having a temperature generally within the range of from 300 to 900° F. Heated nitrogen 37 is then passed into gas turbine system 100 which comprises gas turbine compressor 101, combustor 102 and gas turbine 103.

In the embodiment illustrated in FIG. 1, air 1 is compressed in gas turbine compressor 101 to a pressure generally within the range of from b 150to 450 psia, and resulting compressed air 2 is passed into combustor 102. If desired, as shown by stream 4, a portion of compressed air 2 can be extracted and combined with stream 8. The heat of compression in this combined feed air stream can then be provided to the nitrogen produced from cryogenic air separation plant 200. Fuel 41, such as natural gas, syngas or hydrocarbon liquids, is passed into combustor 102 wherein the fuel and oxygen from compressed air 2 combust to form hot pressurized gas containing combustion reaction products such as carbon dioxide and water vapor. The hot pressurized gas is passed from combustor 102 in stream 51 to gas turbine 103 wherein it is expanded to produce power such as to drive generator 63 to produce electricity.

In the embodiment of the invention illustrated in FIG. 1 heated nitrogen 37 is passed into combustor 102. Alternatively, heated nitrogen 37 could be combined with compressed air stream 2 for passage into combustor 102, or could bypass combustor 102 and be passed directly into gas turbine 103. In whatever arrangement is employed, the heated nitrogen is expanded in gas turbine 103 thereby increasing the amount of power which can be produced by gas turbine 103. The heat brought into the turboexpansion in gas turbine 103 by the heated nitrogen gainfully employs the heat of compression resulting from the compression of the feed air for the cryogenic air separation plant, increasing the efficiency of the overall cryogenic air separation gas turbine integration system.

The exhaust 52 from gas turbine 103 may be sent to steam cycle stream 400 for generating steam that can be expanded to produce more power such as by driving generator 64 or may be passed in stream 53 for usage in other processes.

Figure 2:
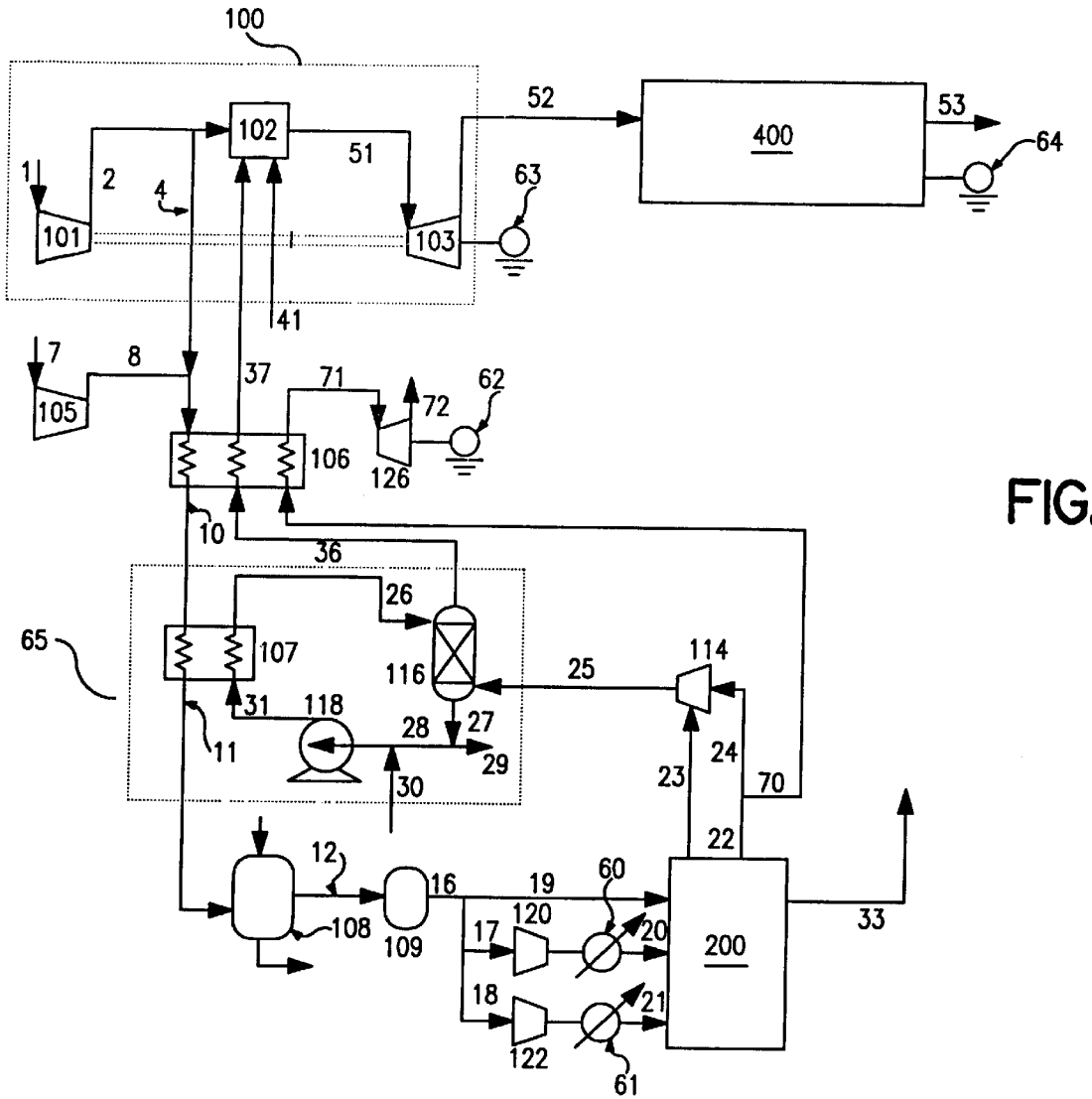
FIG. 2 is a schematic representation of another preferred embodiment of the cryogenic air separation gas turbine integration system of this invention wherein the nitrogen is moisturized prior to heating.

FIG. 2 illustrates another embodiment of the invention wherein the nitrogen is moisturized prior to being heated against the compressed feed air in the high level heat exchanger. The numerals in FIG. 2 are the same as those of FIG. 1 for the common elements, and these common elements will not be described again in detail.

The embodiment illustrated in FIG. 2 employs moisturizing system 65 between high level heat exchanger 106 and cryogenic air separation plant 200. This arrangement further improves the efficiency of the system by effectively utilizing low level heat from the feed air stream. Since compressed feed air stream 8 has a higher flow rate than the combined flows of nitrogen streams 25 and 70, high level heat exchanger 106 is warm-end pinched, and feed air stream 10 at the cold end still contains some thermal energy.

Referring now to FIG. 2, moisturizing system 65 comprises humidifier 116, typically a humidification tower or saturator. Water 26 is passed into the upper portion of humidifier 116 and the diluent nitrogen 25 is passed into the lower portion of humidifier 116. Downflowing water within humidifier 116 directly contacts upflowing nitrogen thereby serving to pass water into the upflowing nitrogen gas resulting in moisturized nitrogen which is then passed in stream 36 to high level heat exchanger 106 for further processing as previously described. Preferably moisturized nitrogen 36 is saturated.

Water 27 from humidifier 116 is split into two portions. A first or blowdown portion 29 is removed from the recirculation loop. A second or recirculation portion 28 is mixed with make-up water 30 and pumped to a higher pressure in pump 118. Resulting pressurized water stream 31 is passed to low level heat exchanger 107 wherein it is heated by indirect heat exchange with further cooling feed air 10 taken from high level heat exchanger 106. Resulting heated water 26 is passed from low level heat exchanger 107 to humidifier 116 in stream 26. The heat in stream 26 improves the mass transfer driving force within humidifier 116. In this way low level heat in the feed air to the cryogenic air separation plant is effectively utilized to increase the mass of the nitrogen stream sent to the gas turbine and thus to increase the power production from the gas turbine. The resulting feed air from low level heat exchanger 107 is passed in stream 11 to direct contact aftercooler 108 and further processed as was previously described.

Although the invention has been described in detail with reference to certain preferred embodiments, those skilled in the art will recognize that there are other embodiments of the invention within the spirit and the scope of the claims. For example, hot water or steam from the steam cycle system may be used to supply additional heat to increase the saturation level of the nitrogen stream. In another embodiment a portion of the nitrogen may be used for acid gas, e.g. carbon dioxide, removal in an acid gas removal system prior to being sent to the gas turbine. In another embodiment a portion of compressed feed air 8 may be passed to combustor 102 rather than being passed to the high level heat exchanger. In yet another embodiment, oxygen from the cryogenic air separation plant, which may be heated in a manner similar to that of the nitrogen heating, may be used in a gasification plant to produce synthesis gas, e.g. hydrogen and carbon monoxide, from the partial combustion of dirty fuel such as coal, petroleum coke, refinery residual oil, etc., and the resulting clean syngas may be used as the fuel in the combustor of the gas turbine system.

What is claimed is:

1. A method for operating a cryogenic air separation and gas turbine system comprising:

(A) compressing feed air in a non-intercooled feed air compressor to produce compressed feed air having heat of compression, and cooling the compressed feed air;

(B) passing the compressed feed air into a cryogenic air separation plant and producing nitrogen by the cryogenic rectification of the feed air within the cryogenic air separation plant;

(C) withdrawing nitrogen from the cryogenic air separation plant and heating the withdrawn nitrogen by indirect heat exchange with the compressed feed air having heat of compression to produce heated nitrogen;

(D) turboexpanding the heated nitrogen in a gas turbine; and (E) compressing air in a gas turbine compressor and passing at least some of the resulting compressed air into a combustor.

2. The method of claim 1 wherein the heated nitrogen is passed to the combustor prior to being turboexpanded.

3. The method of claim 1 further comprising adding water to the withdrawn nitrogen prior to the heating of the withdrawn nitrogen.

4. The method of claim 3 wherein the water added to the withdrawn nitrogen is first heated by indirect heat exchange with compressed feed air.

5. Cryogenic air separation and gas turbine apparatus comprising:

(A) a non-intercooled feed air compressor, a high level heat exchanger, means for passing feed air to the feed air compressor, and means for passing feed air from the feed air compressor to the high level heat exchanger;

(B) a cryogenic air separation plant and means for passing feed air from the high level heat exchanger to the cryogenic air separation plant;

(C) means for passing nitrogen from the cryogenic air separation plant to the high level heat exchanger;

(D) a gas turbine and means for passing nitrogen from the high level heat exchanger to the gas turbine; and (E) a gas turbine compressor, a combustor, means for passing air to the gas turbine compressor, and means for passing air from the gas turbine compressor to the combustor.

6. The apparatus of claim 5 wherein the means for passing nitrogen from the high level heat exchanger to the gas turbine includes the combustor.

7. The apparatus of claim 5 further comprising a low level heat exchanger wherein the means for passing feed air from the high level heat exchanger to the cryogenic air separation plant includes the low level heat exchanger.

8. The apparatus of claim 5 further comprising a humidifier wherein the means for passing nitrogen from the cryogenic air separation plant to the high level heat exchanger includes the humidifier.

9. The apparatus of claim 5 further comprising a low level heat exchanger and a humidifier wherein the means for passing feed air from the high level heat exchanger to the cryogenic air separation plant includes the low level heat exchanger and the means for passing nitrogen from the cryogenic air separation plant to the high level heat exchanger includes the humidifier, and further comprising means for passing water to the low level heat exchanger and means for passing water from the low level heat exchanger to the humidifier.

10. The apparatus of claim 5 further comprising a nitrogen turbine, means for passing excess nitrogen from the cryogenic air separation plant to the high level heat exchanger, and means for passing excess nitrogen from the high level heat exchanger to the nitrogen turbine.

11. The method of claim 1 wherein a portion of the air compressed in the gas turbine compressor is passed into the cryogenic air separation plant.

12. The apparatus of claim 5 further comprising means for passing air from the gas turbine compressor to the cryogenic air separation plant.

* * * * *